US006129581A

United States Patent [19]

Lee

[11] Patent Number: 6,129,581

[45] Date of Patent: Oct. 10, 2000

[54] HIGH FREQUENCY SERIAL BUS CONNECTOR

[76] Inventor: Su-Lan Yang Lee, 8th Fl., No. 506-2, Yuan-Shan Road, Chung Ho City, Taipei Hsien, Taiwan

[21] Appl. No.: 09/216,842

[22] Filed: Dec. 21, 1998

[51] Int. Cl.[7] ..... H01R 12/24; H01R 9/05

[52] U.S. Cl. ..... 439/497; 439/579

[58] Field of Search ..... 439/610, 274, 439/578, 579, 497, 597, 874

[56] References Cited

U.S. PATENT DOCUMENTS 5,041,021 8/1991 Sato ..... 439/685

5,711,686 1/1998 O'Sullivan ..... 439/610

*Primary Examiner*—Lincoln Donovan

*Assistant Examiner*—Chandrika Prasad

*Attorney, Agent, or Firm*—Rosenberg, Klein & Lee

[57] ABSTRACT

A high frequency serial bus connector is provided. The connector includes a main body within which a plurality of terminal members are respectively received for connection with the signal and power wires of a shielded cable. The connector also includes a wire clamping member that clamps securely together a power wire and the signal wire shielding meshes of the cable. The clamping member is formed with a clamping section from which an insertion pin extends longitudinally and an arcuate soldering plate extends laterally. The insertion pin engages a fixing cavity formed in the main body, while the soldering plate engages an adjacent terminal member.

1 Claim, 6 Drawing Sheets

HIGH FREQUENCY SERIAL BUS CONNECTOR

BACKGROUND OF THE INVENTION

The present invention relates to a high frequency serial bus connector in which a wire clamping member is used to tightly embrace and clamp a power wire and shielding meshes with which the signal wire bundles are wrapped in a cable. The wire clamping member is slidably positioned in the plastic main body of the connector and soldered with one of the terminal members inserted therein.

FIG. 1 shows an existing high frequency serial bus connector 6. In such connector 6, each signal wire bundle 71*a*, 71*b*, 72*a*, 72*b* in the cable 7 is correspondingly soldered with a terminal member 8. Also, one power wire 73 in the cable 7 is directly soldered with a terminal member 8. A rear end portion of another power wire 74 in the cable 7 is soldered with the shielding meshes 7*a*, 7*b* wrapping the signal wire bundles 71*a*, 71*b*, 72*a*, 72*b*. The rear end of the power sire 74 is soldered with a corresponding terminal 8'. The above conventional connector has some shortcomings in manufacturing and use as follows:

1. The shielding meshes 7*a*, 7*b* wrapping the signal wire bundles 71*a*, 71*b*, 72*a*, 72*b* are respectively soldered with the power wire 74. The power wire has quite small diameter and the connector has very small volume so that it is difficult to perform the soldering in a limited space.

2. Interference often takes place at the soldering point P between the shielding meshes 7*a*, 7*b* and the power wire 74 and thus the quality of the product can be hardly ensured.

3. The shielding meshes 7*a*, 7*b* are connected with the power wire 74 by soldering. In assembling operation, the shielding meshes 7*a*, 7*b* are apt to detach from the power wire due to pulling. This will result in a defective product.

SUMMARY OF THE INVENTION

It is therefore a primary object of the present invention to provide a high frequency serial bus connector including a plastic main body having a front end formed with a fitting socket in which a corresponding terminal connector is snugly fitted, a terminal accommodating sect rearward extending from a rear end of the main body, the upper and lower sides of the terminal accommodating seat being respectively formed with multiple axial terminal receptacles forward extending through the main body, multiple terminal members being respectively inserted in the terminal receptacles for connecting with the signal wires and one power wire in a cable, a front section of the terminal member extending into the fitting socket, one side of the terminal accommodating seat being formed with a slide channel; a wire clamping member for tightly embracing and clamping a power wire and the shielding meshes with which the signal wire bundles are wrapped in a cable, the wire clamping member being slidably snugly located in the slide channel of the main body and soldered with one of the terminal members; and a shielding housing housing the main body, a rear section of the shielding housing being wrapped with an insulative outer cover layer to form the high frequency serial bus connector.

The present invention can be best understood through the following description and accompanying drawings, wherein:

DETAILED DESCRIPTION OF THE PREFERRED EMBODIMENTS

Figure 1:
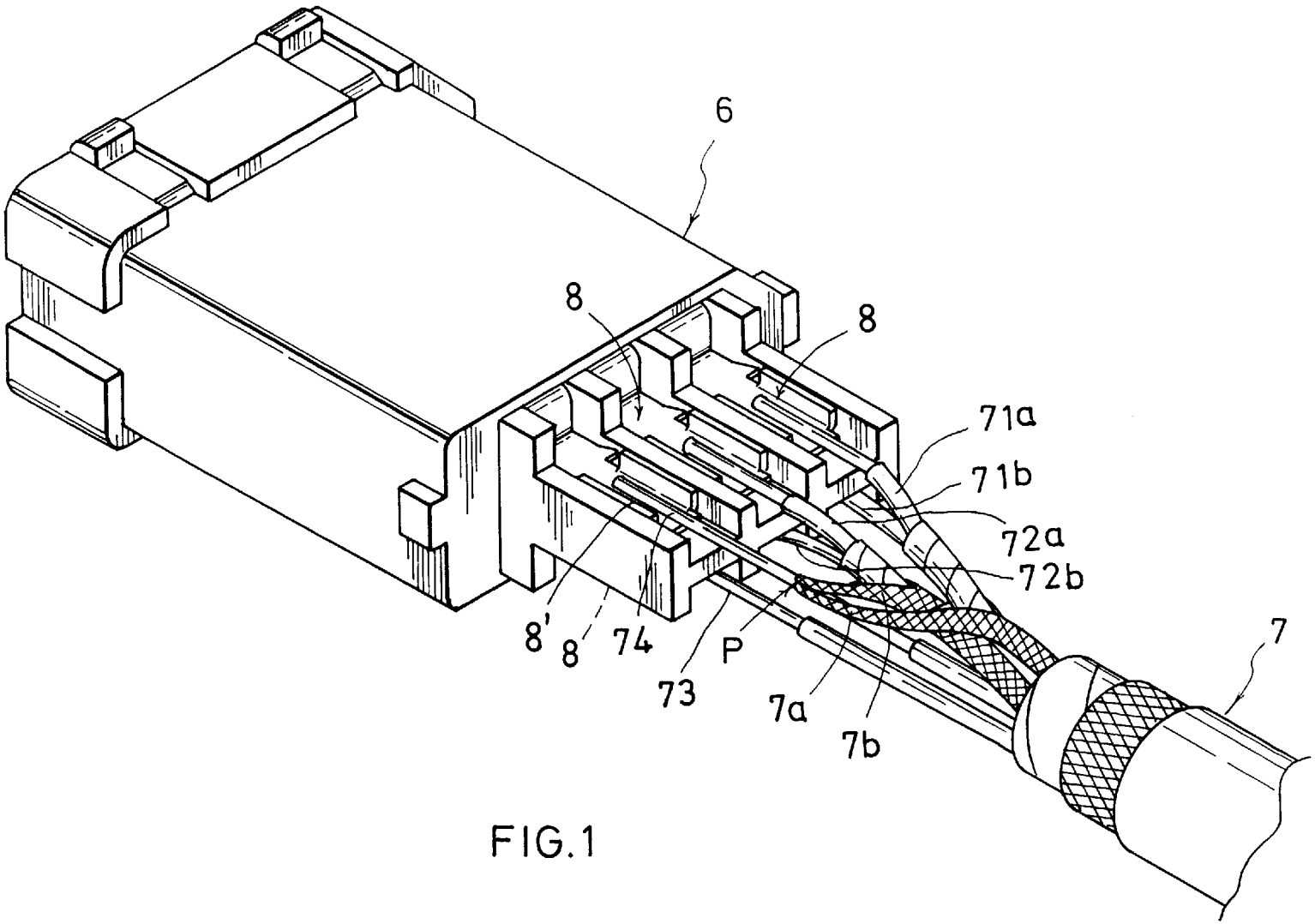
FIG. 1 is a perspective view of a conventional connector.

Please refer to FIGS. 2 to 7. The high frequency serial bus connector 100 of the present invention includes: a plastic main body 1 having a front end formed with a fitting socket 111 in which a corresponding terminal connector (not shown) is fitted; multiple terminal members 2 respectively inserted in the main body 1; a wire clamping member 3 for tightly embracing and clamping a power wire 41*a* and the shielding meshes 421*a* 421*b* with which the signal wire bundles 42*a*, 42*b* are wrapped in a cable 4, the wire clamping member 3 being slidably located at a rear end of the main body 1 and attached to and soldered with one of the terminal members 2 and a shielding housing 5 made of metal material and housing the main body 1. A rear section of the shielding housing 5 is wrapped with an insulative outer cover layer 53 to form the high frequency serial bus connector.

Please refer to FIGS. 2 to 5. The plastic main body 1 includes: a cartridge 11 formed on a front section of the main body 1, a front end face of the cartridge 11 being formed with a fitting socket ill, a terminal accommodating seat 12 rearward extending from a rear end of the cartridge 11, the terminal accommodating seat 12 being formed with multiple parallel terminal receptacles 121 axially forward extending through the cartridge 11, whereby when the terminal members 2 are respectively inserted in the terminal receptacles 121, a rear wire connecting section 21 of each terminal member 2 is rested on the terminal accommodating seat 12 and a front conductive section 22 of the terminal member 2 securely extends into the fitting socket 111; and a slide channel 13 extending from the rear end of the main body 1 into the main body 1 and adjacent to one of the terminal receptacles 121. The wire clamping member 3 is snugly inserted in the slide channel 13.

An outer periphery of the main body 1 is formed with multiple locating channels 14 and locating projections 15 for assembling with the shielding housing 5. Such structures pertain to prior art and will not be limited in shape.

Figure 3:
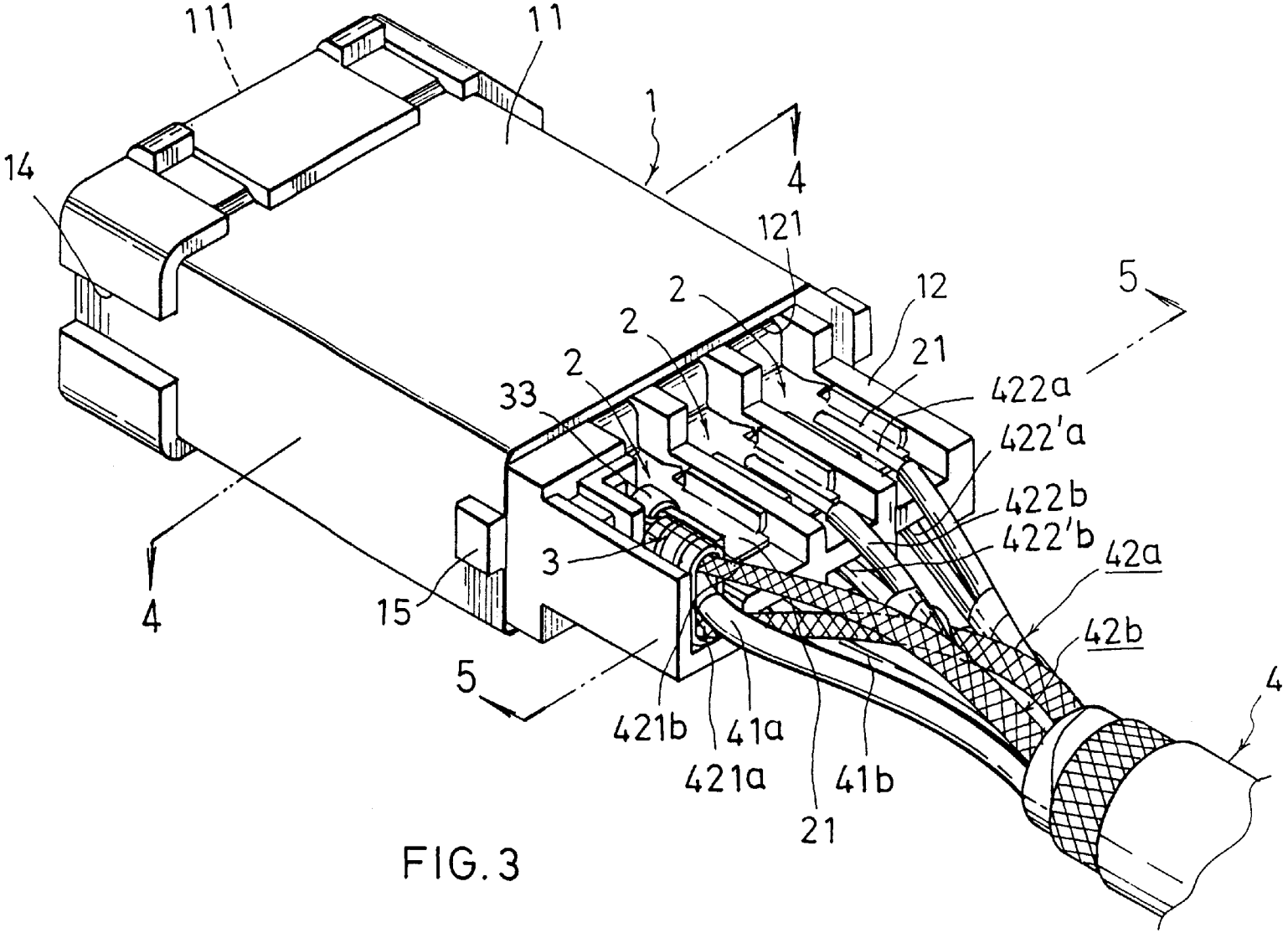
FIG. 3 is a perspective assembled view of the main body of the present invention, showing that the wires of the cable are connected with the main body.
Figure 4:
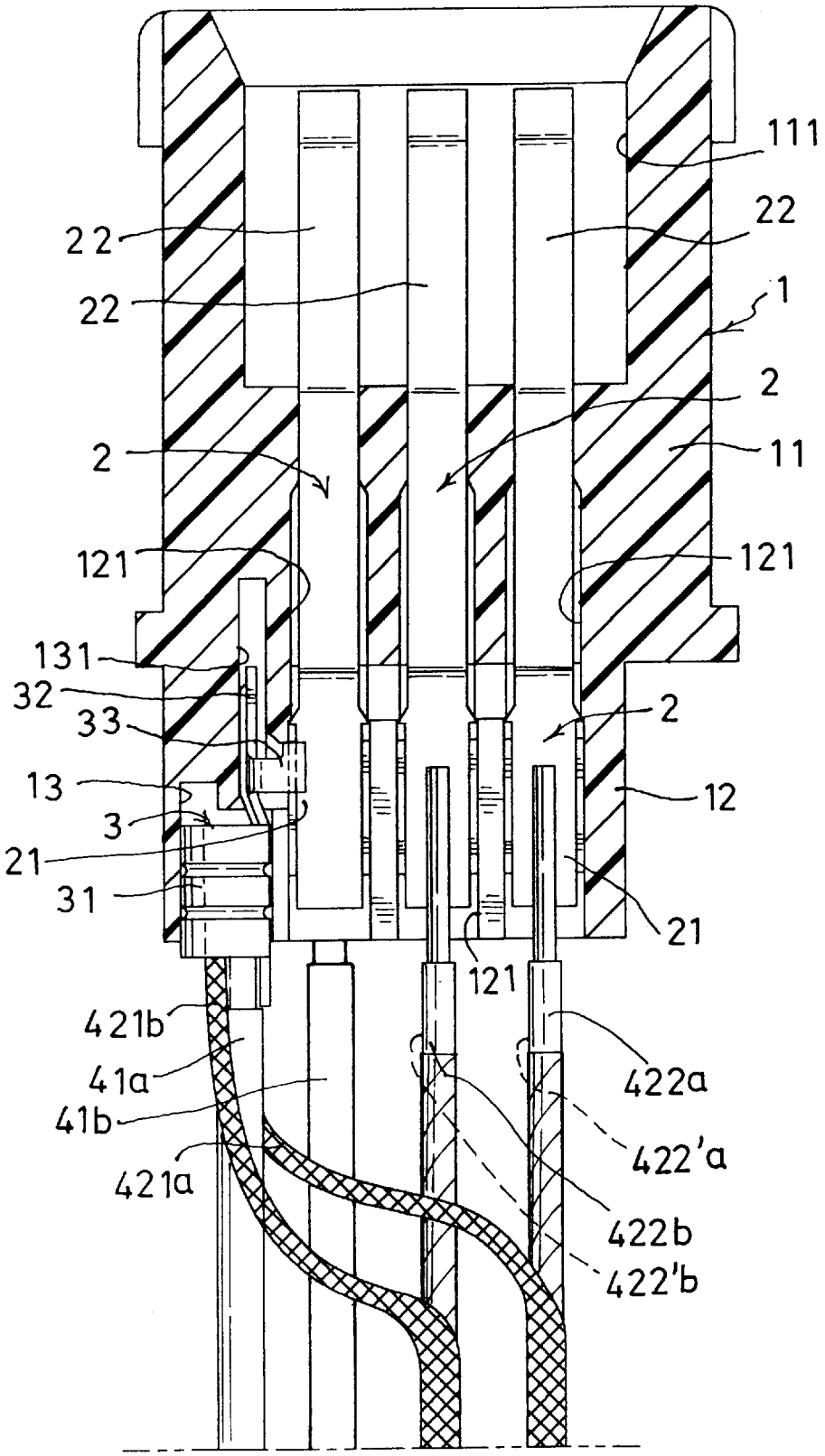
FIG. 4 is a sectional view taken along line 4—4 of FIG. 3.
Figure 5:
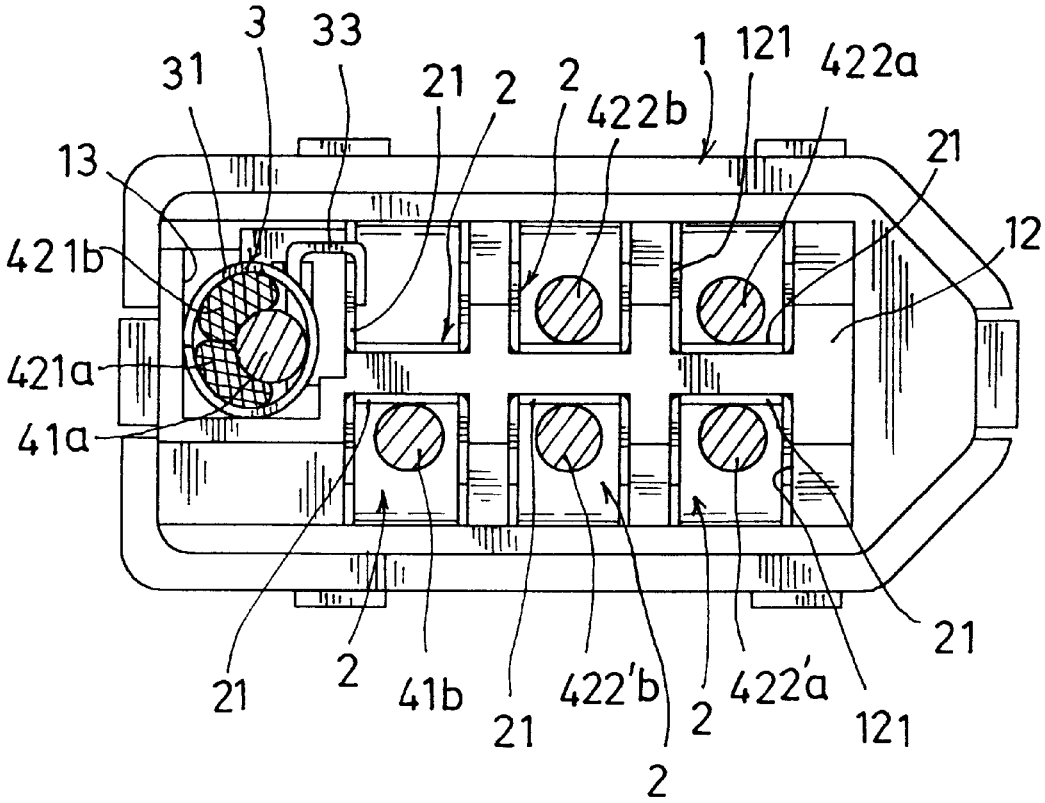
FIG. 5 is a sectional view taken along line 5—5 of FIG. 3.
Figure 6:
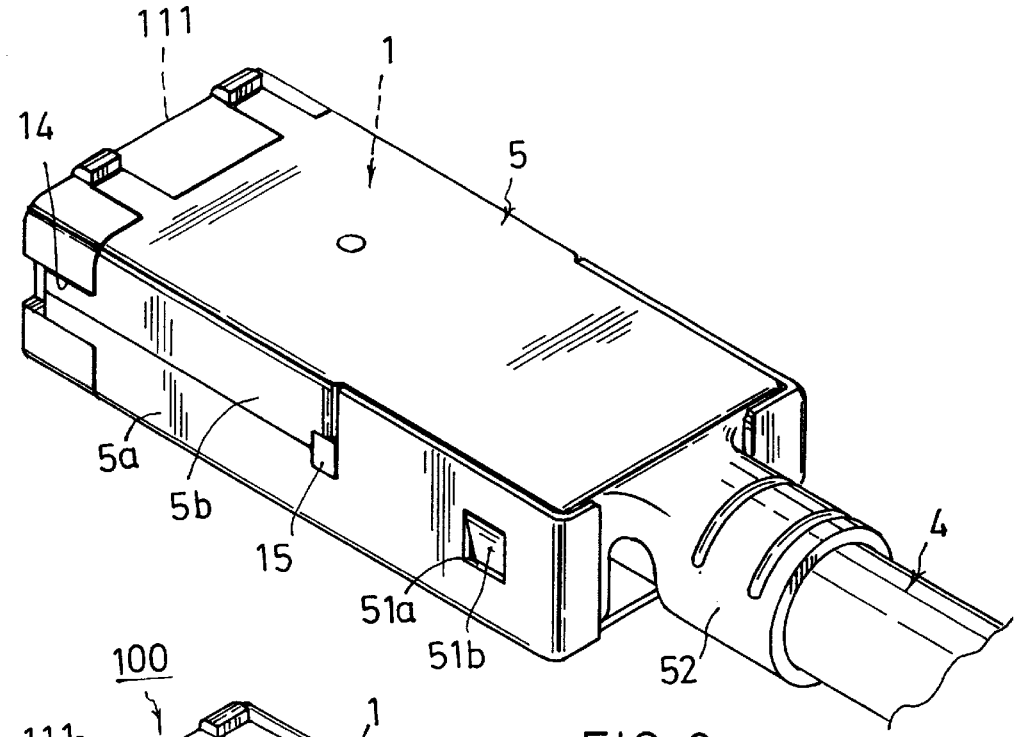
FIG. 6 is a perspective view showing the main body and the shielding housing cf the present invention.
Figure 7:
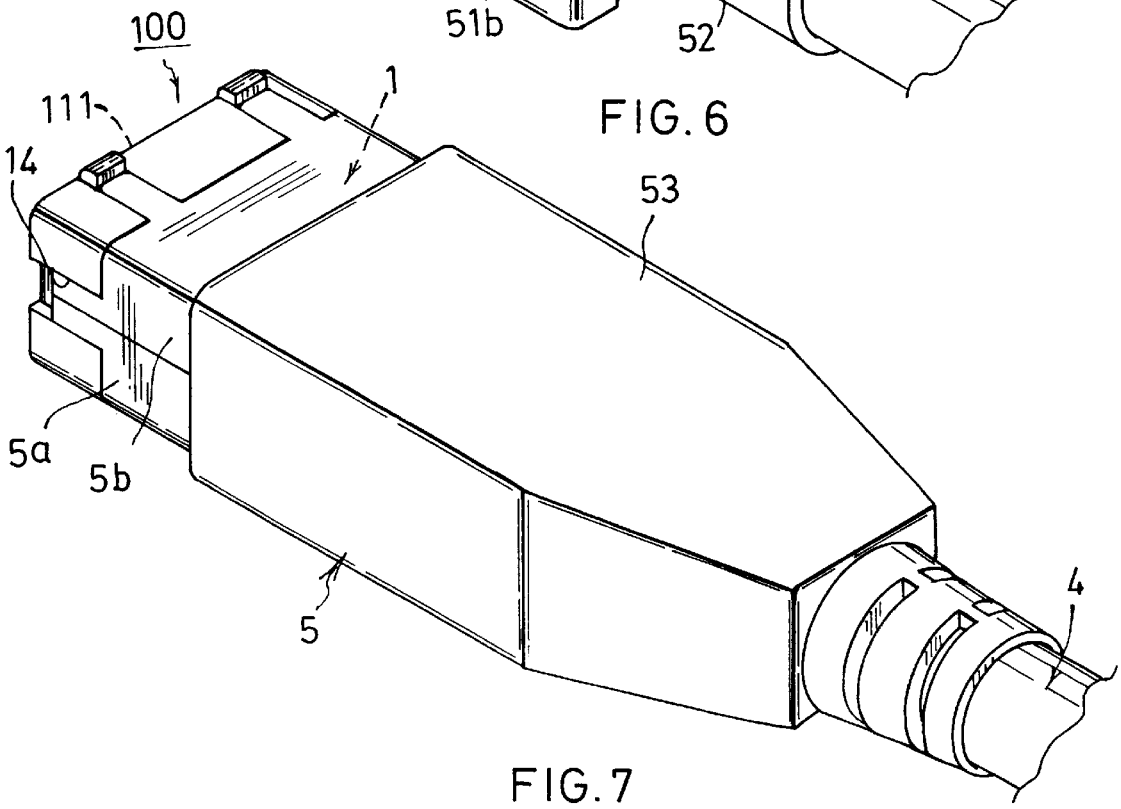
FIG. 7 is a perspective view showing the appearance of the present invention.

As shown in FIGS. 3, 4 and 5, the rear wire connecting sections 21 of four terminal members 2 are respectively soldered with the signal wires 422*a*, 422'*a*, 422*b*, 422'*b* of two signal wire bundles 42*a*, 42*b* of the cable 4. In addition, the rear wire connecting section 21 of one terminal member 2 is soldered with another power wire 41*b* in the cable 4*b*. Then the wire clamping member 3 tightly embracing and clamping the power wire 41*a* and the shielding meshes 421*a*, 421*b* of the signal wire bundles 42*a*, 42*b* is slidably positioned in the slide channel 13. The wire clamping member 3 is soldered with another terminal member 2 to complete the layout of the wires of the present invention.

The shielding meshes 421*a*, 421*b* and the power wire 41*a* are embraced by the wire clamping member 3 which is connected with the terminal member 2 at single soldering point, so that the interference is reduced and the shielding meshes 421*a*, 421*b* and the power wire 41*a* are tightly clamped and prevented from detachment due to pulling during manufacturing procedure. Therefore, the ratio of good quality product can be increased.

Figure 2:
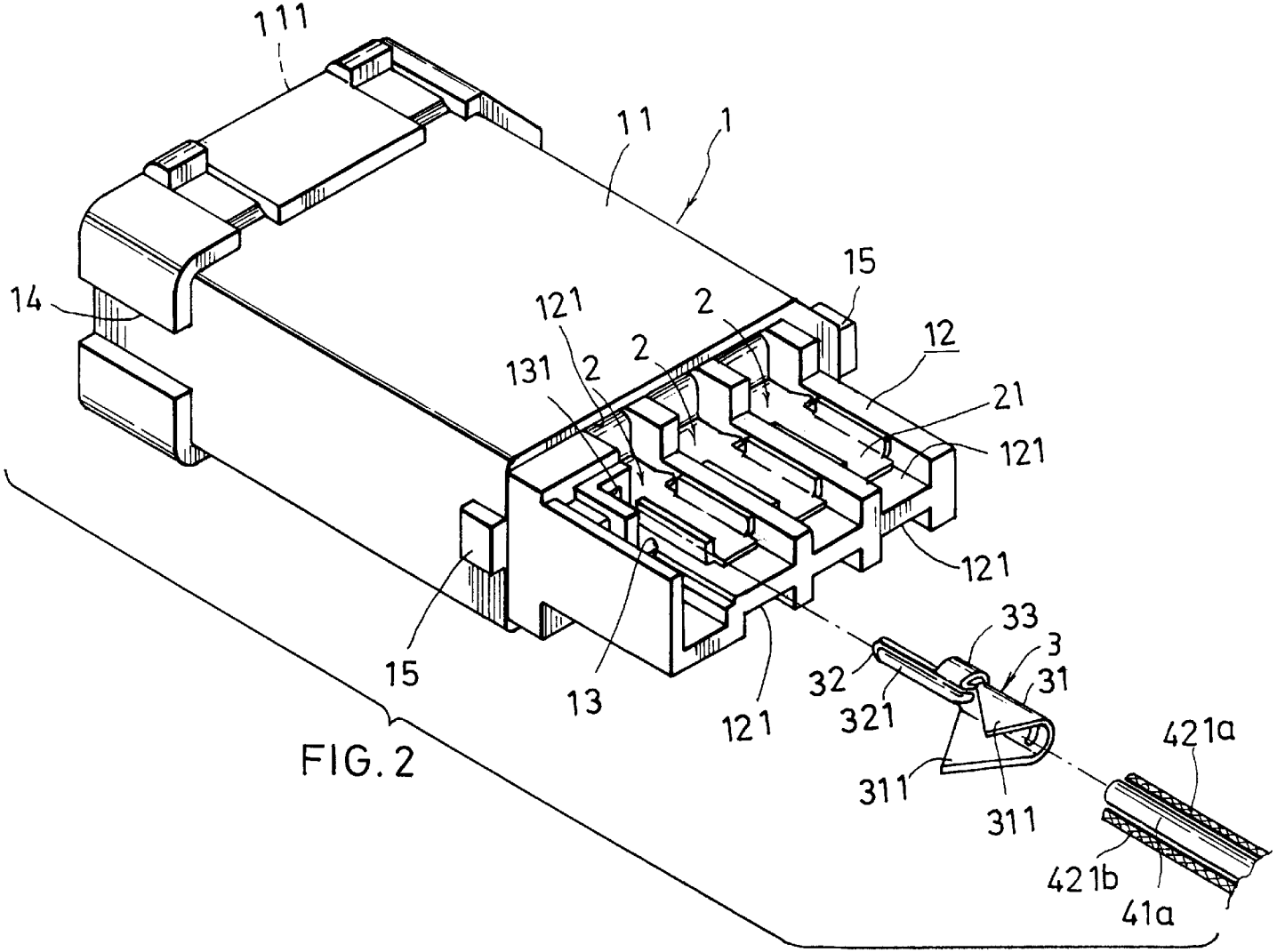
FIG. 2 is a perspective exploded view of the plastic main body and wire clamping member of the present invention.

Please refer to FIGS. 2, 3 and 5. The wire clamping member 3 includes: a wire clamping section 31 having at least one bent wire clamping panel 311 for clamping and embracing the shielding meshes 421*a*, 421*b* and the power wire 41*a*; an insertion pin 32 forward extending from the front end of the wire clamping section 31 for snugly inserting into a fixing cavity 131 formed at bottom end of the slide channel 13 of the main body 1; and a soldering plate 33 bending laterally extending from a top edge of the insertion pin 32 to be soldered with an adjacent terminal member 2.

The insertion pin 32 of the wire clamping member 3 is punched with at least one reinforcing rib 321 for increasing the strength of the insertion pin 32, whereby the insertion pin 32 can be successfully inserted into the fixing cavity 131 of the slide channel 13.

The shielding housing 5 is formed by two casings 5*a*, 5*b* mated with each other. The casing 5*a* is formed with multiple latch holes 51*a*, while the other casing 5*b* is formed with multiple corresponding latch hooks 51*b* for latching with the latch holes 51*a*, whereby the main body 1 is firmly enclosed in the shielding housing 5. A rear end of the casing 5*b* is formed with a projecting wire holder 52 for tightly embracing the cable 4. The shape of the shielding housing 5 is not limited.

The high frequency serial bus connector of the present invention is characterized in that the shielding meshes 421*a*, 421*b* of the signal wire bundles 42*a*, 42*b* and the power wire 41*a* in the cable 4 are tightly embraced and clamped by the wire clamping member 3 which is slidably positioned in the main body 1 and soldered with one of the terminal members 2. Accordingly, the present invention has the following advantages:

1. The shielding meshes 421*a*, 421*b* and the power wire 41*a* are tightly embraced and clamped by the wire clamping member 3 without soldering. Therefore, the interference is reduced and the quality is enhanced.

2. In manufacturing, the shielding meshes 421*a*, 421*b* are prevented from detachment due to pulling so that the ratio of good product is increased.

3. The present invention has simple structure and can be quickly and easily assembled.

When assembling the high frequency serial bus connector, the shielding meshes 421*a*, 421*b* and the power wire 41*a* can be first twisted into one bundle and then tightly embraced and clamped by the wire clamping member 3.

It is to be understood that the above description and drawings are only used for illustrating one embodiment of the present invention, not intended to limit the scope thereof. Any variation and derivation from the above description and drawings should be included in the scope of the present invention.

What is claimed is:

1. A high frequency serial bus connector assembly comprising:

a plastic main body including a cartridge, a front end of the cartridge being formed with a fitting socket, a terminal accommodating seat rearward extending from a rear end of the cartridge, the terminal accommodating seat being formed with multiple parallel terminal receptacles axially forward extending through the cartridge, the rear end of the main body being formed with a slide channel and a fixing cavity adjacent thereto;

multiple terminal members respectively inserted in the terminal receptacles of the main body, a rear wire connecting section of each terminal member being rested on the terminal accommodating seat and a front conductive section of the terminal member securely extending into the fitting socket, the wire connecting sections of the terminal members being respectively soldered with shield mesh wrapped signal wire bundles and a first power wire of a cable;

a wire clamping member slidably engaging the slide channel of the main body, the wire clamping member having a clamping section and an insertion pin extending longitudinally therefrom;

the clamping section including: a malleable clamping panel captively enveloping portions of the shielding meshes and a second power wire of the cable; and an arcuate soldering plate conductively coupled to the clamping panel and extending laterally therefrom to engage at least one terminal member disposed adjacent the slide channel;

the insertion pin extending into and frictionally engaging the fixing cavity, the insertion pin having protruding therefrom a reinforcing rib for securing the frictional engagement thereof within the fixing cavity; and, a shielding housing made of metal material and housing the main body, a rear section of the shielding housing being coated with an insulative outer cover layer.

* * * * *